United States Patent [19]

Schlage

[11] 3,966,289

[45] June 29, 1976

[54] ELECTRIC POWER COUPLER

[76] Inventor: Ernest L. Schlage, 219 Bloomfield Road, Burlingame, Calif. 94010

[22] Filed: May 16, 1975

[21] Appl. No.: 578,080

[52] U.S. Cl. ..... 339/4; 292/144

[51] Int. Cl.[2] ..... H01R 39/00

[58] Field of Search ..... 339/4, 2 R; 70/146; 292/144 X

[56] References Cited

UNITED STATES PATENTS 3,456,974 7/1969 Moore ..... 292/359

*Primary Examiner*—Roy Lake

*Assistant Examiner*—DeWalden W. Jones

[57] ABSTRACT

An electric power coupler for use with first and second door members relatively movable along a predetermined path toward and away from substantial abutment has a first frame mounted on the first door member. An inner pair and an outer pair of first frame electrical connectors are mounted on the first frame in a recess therein having a lateral opening in the direction of the path. The first connectors have exposed surfaces parallel to the path. At least some of the connectors are resilient in a direction normal to the path. The second frame is mounted on the second door member and supports a plunger for movement in a direction normal to the path. The plunger is spring urged to project, and cam surfaces on the first frame and the second frame cause the plunger to retract. The plunger has opposite walls partly defining a chamber therein having a lateral aperture confronting the recessed opening. An inner pair and an outer pair of second frame electrical connectors are respectively disposed on the opposite walls. The second connectors have exposed surfaces parallel to the path and in position to engage the exposed surfaces of the first connectors. At least some of the second connectors are resilient in a direction normal to the path. Flexible conductors join the second connectors to terminal posts on the second frame.

14 Claims, 16 Drawing Figures

FIG_1
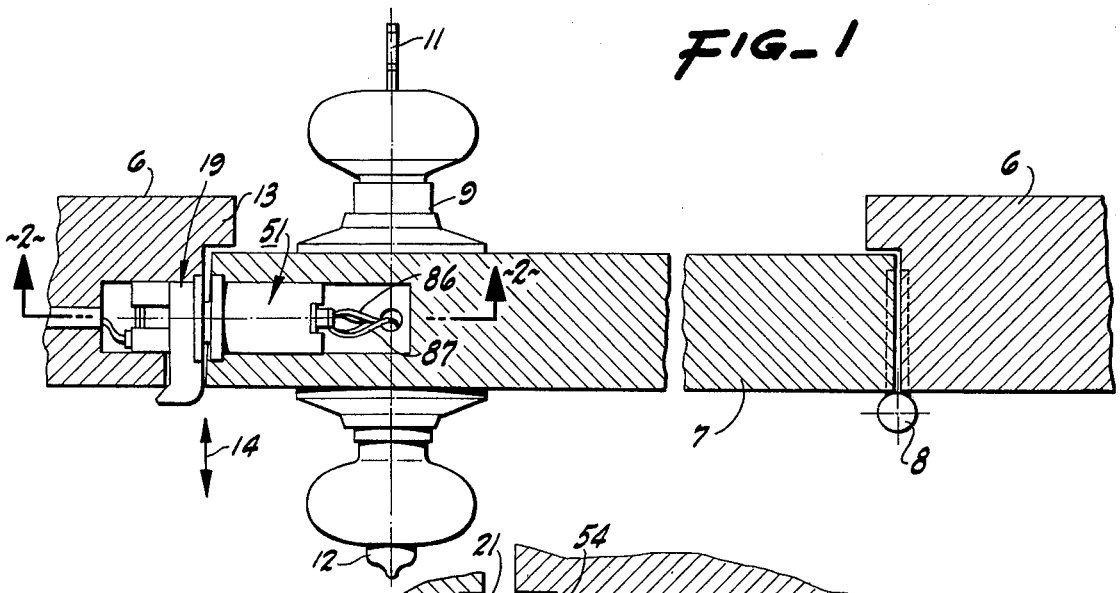
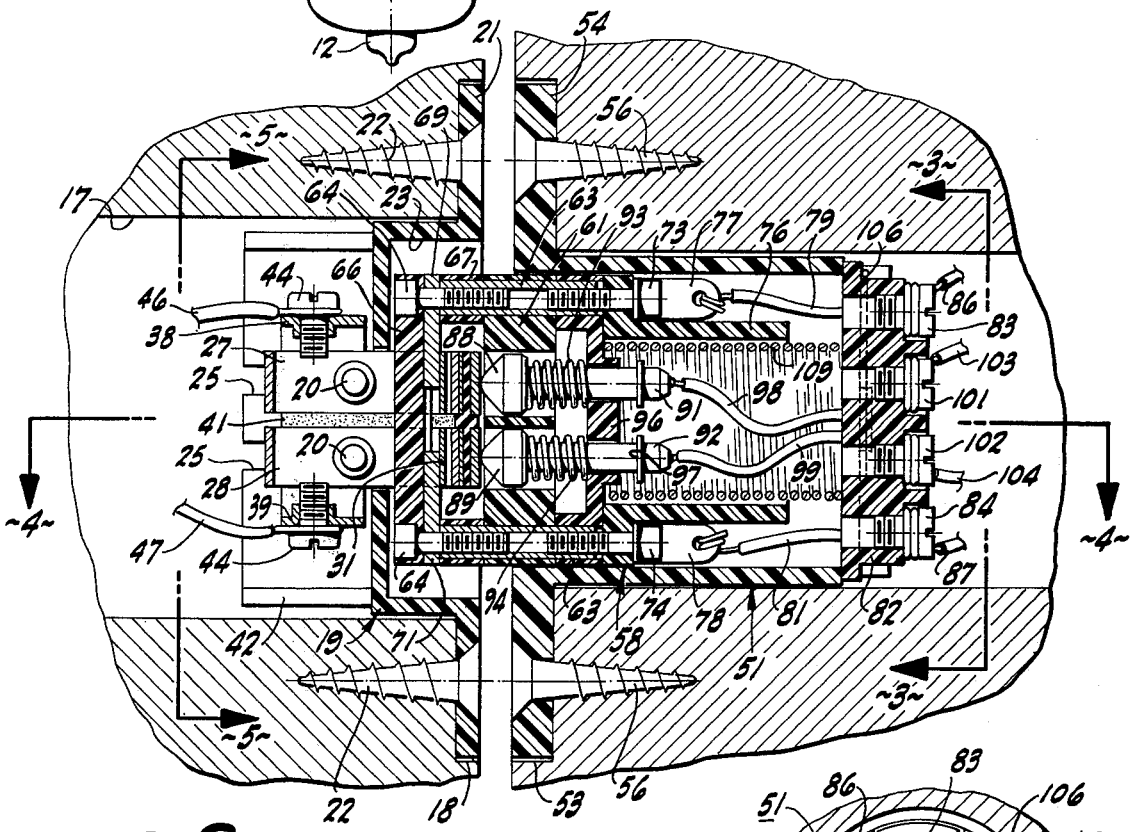
FIG_2
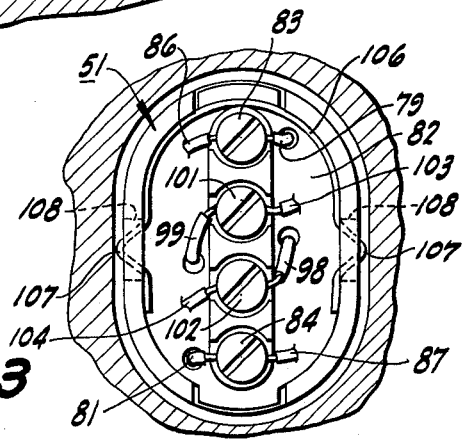
FIG_3

FIG-9
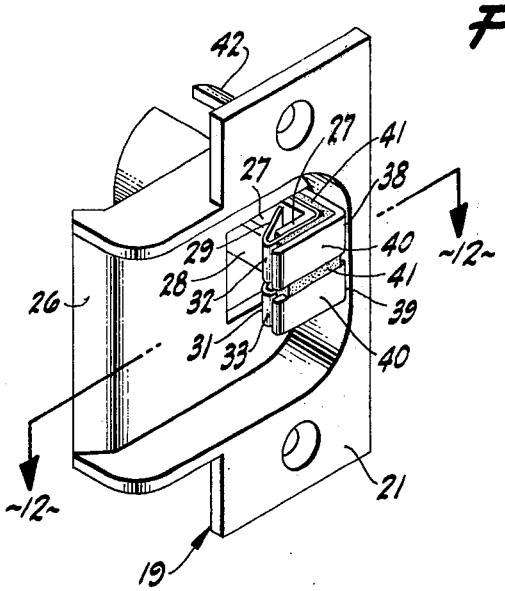
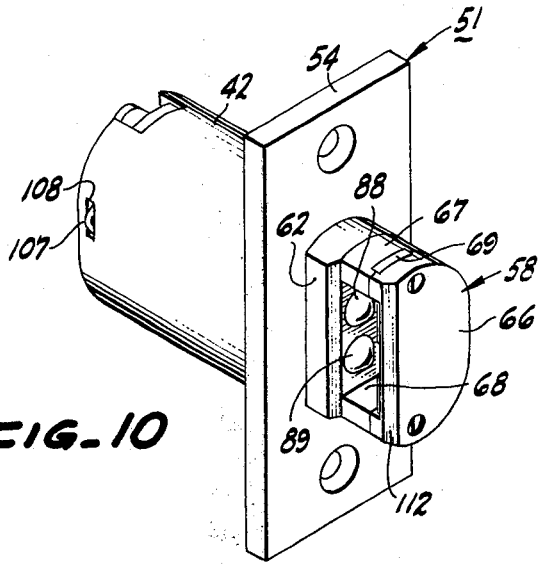
FIG-10
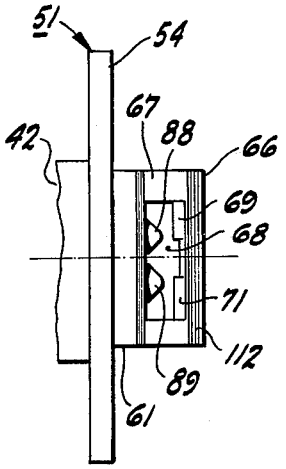
FIG-11
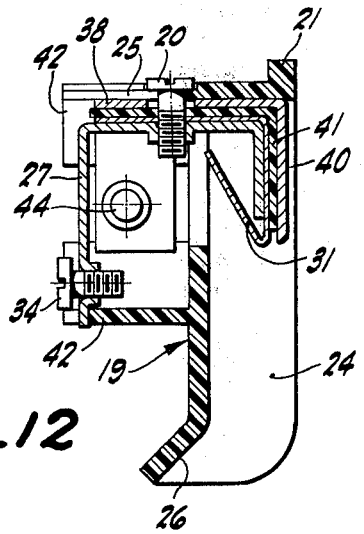
FIG-12

ELECTRIC POWER COUPLER

There is an increasing requirement to mount on a door any one or more of several different devices requiring electrical actuation. For example, door lock sets mounted on a door frame and on a door panel are actuated either by electrical power or are under electrical control. There is a problem in supplying the actuating power or the central signal, or both, to the door lock unit of the panel. This is sometimes done by utilizing metallic hinges and carrying conductors through the door panel. This is disadvantageous in that the circuit is subject to tampering and the installation is expensive. The requirement for the power is at the free edge of the sliding or swinging door panel. The most direct route for current is between the door frame and the panel free edges when the panel is closed, but the opening, when the panel is open, must not in any way be obstructed. Any installation should be very simply made by ordinary workmen, by tools readily available, and without causing any defacement or unusual appearance of the door. Electrical contacts utilized should not only be self-cleaning in order to maintain their electrical integrity but likewise should be guarded or protected in such a way that they do not afford ready access to unauthorized operation. Door sagging or door rattling which may occur from time to time must not disrupt the electrical continuity through the closed contacts. There should be no unusual projections which might catch clothing or touch a person utilizing the open doorway. A relatively large number of connections allow for reasonably elaborate power and control functions, but the contacts must not accidentally provide cross connections due to door sag or rattle and the like. The arrangement should be useful not only with the customary insulated or wooden doors but also with conducting metallic doors and door frames. The operation of the coupler must be positive but also easy or light as not to interfere with the operation of the customary door latch used with or without a door closer.

It is an object of the invention, therefore, at least to fulfill all of the requirements set forth hereinabove and particularly to provide an electric power coupler for a door which can be utilized with any two relatively movable door elements travelling into substantial abutment along a predetermined path.

A further object of the invention is in general to provide an improved electric power coupler especially for use with doors.

A further object of the invention is to provide a coupler that can be utilized with appropriate voltages without risk of harm.

Other objects of the invention together with the foregoing are attained in the embodiments of the invention described in the accompanying description and illustrated in the accompanying drawings, in which:

FIG. 1 is a cross-section on a horizontal plane through a door frame and door panel constructed pursuant to the invention and showing the electric power coupler installed therein;

FIG. 2 is an enlarged cross-section on a vertical plane, the plane section being indicated by the line 2—2 of FIG. 1;

FIG. 3 is an end view, the plane of the view being illustrated by the line 3—3 of FIG. 2;

FIG. 9 is an isometric perspective view showing the first frame;

FIG. 10 is an isometric view similar to FIG. 9 and showing the second frame but in a reverse position;

FIG. 11 is a side elevation of the second frame, portions being broken away;

FIG. 12 is a cross-section, the plane of which is indicated by the line 12—12 of FIG. 9;

Figure 4:
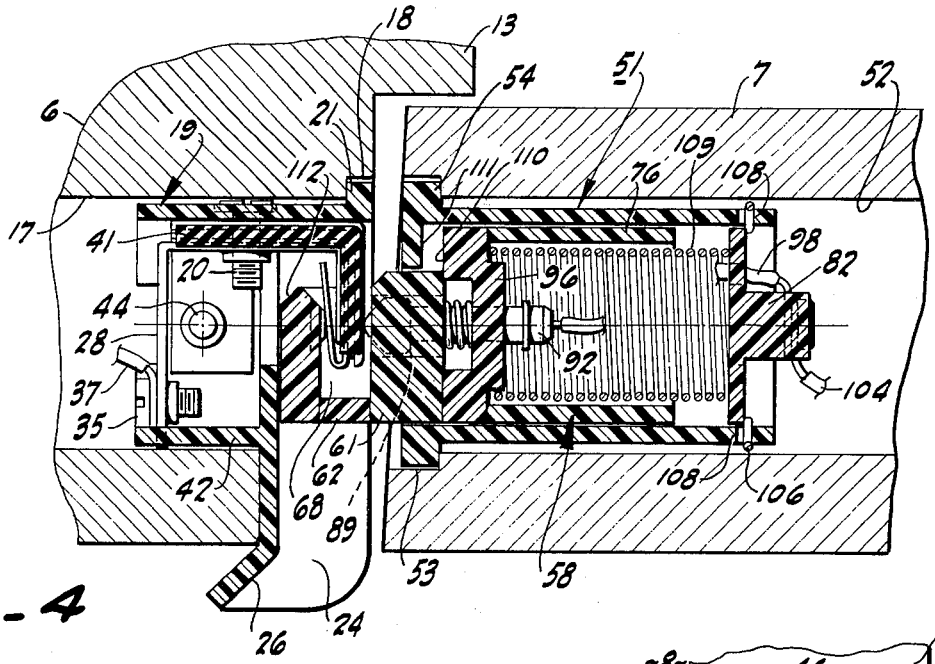
FIG. 4 is a cross-section, the plane of which is indicated by the line 4—4 of FIG. 2.

The coupler of the invention can be utilized in connection with various relatively movable door members whether sliding or swinging. A typical, exemplary installation includes a door frame 6 of the usual sort on which a door panel 7 is mounted to swing by hinges 8. The door panel is preferably provided with a lock set 9 of the customary sort, the exterior side being represented by a key 11 and the interior side being represented by a button 12. An appropriate electrically responsive lock set is shown in the application for patent of Ernest L. Schlage, Serial Number 458,532 filed April 8, 1974 and assigned to the assignee hereof. The frame 6 includes a door stop 13 so that the position of the door panel when closed is relatively fixed, although in many installations there is some shrinkage or warpage or settling. The precise location of the door panel with respect to the door frame is not precisely established. The door panel swings with its free edge following an arcuate path having approximate closed directions represented by the arrow 14 in FIG. 1.

Pursuant to the invention, the door frame 6 is provided with a bore 17 of the sort made for the reception of standard lock hardware and is likewise provided with a standard recess 18. Fitted into such recess is a largely tubular coupler first frame 19 conveniently made of a nonconducting material. The first frame includes a strike plate 21 and is secured in position by means of screws 22. The first frame is formed to define a recess 23 open through the face plate 21 and also having a lateral opening 24, FIG. 4, extending in the general direction of the path 14 and leading to a camming surface 26.

Mounted on the first frame 19 by screws 20 slidable in slots 25 is a pair of inner connectors 27 and 28, FIG. 9, both having resilient tips 29 and 31 of a nature to spring in a direction normal to the path 14, and extending generally parallel with the direction 14 and spaced apart vertically with a predetermined distance between them. The resilient tips afford exposed surfaces 32 and 33. The connectors 27 and 28 are provided with screw terminals 34 and 35 for conductors 36 and 37. The number of conductors may vary from one up and two conductors are sufficient in many cases but preferably, as shown in the present instance, four conductors are utilized in order to afford not only elementary power conduction but also to allow for various signalling circuits and combinations. There is no particular limitation on the signalling or power capability of the mechanism but in practice the power is often limited to a supply at twenty-four volts or less so that carpenters can make the installation, a higher voltage, under union rules, requiring employment of electricians.

For this reason the inner pair of connectors 27 and 28 is supplemented by an outer pair of connectors 38 and 39 having exposed surfaces 40 extending generally parallel to the direction 14. The two pairs of connectors are preferably separated by an intervening insulating layer 41. The connectors 38 and 39 of the outer pair are vertically spread and are disposed in an open extension 42 of the frame 19. They are inturned to carry terminal screws 44 for connection to appropriate conductors 46 and 47 with the conductors 36 and 37 through the bore 17 for connection to the current supply or signalling circuits. In this way, there are supplied in the first frame, particularly in the recess thereof, four contact members or connectors available for engagement.

To cooperate with the first frame 19 mounted in the door frame 6 is a partly tubular second frame 51 disposed in a bore 52 extending part way into the panel 7. The bores are customarily made by the kind of tools normally utilized for lock set installation. The bore 52 is supplemented by a mortised undercut 53. An integral, apertured face plate 54 at one end of the second frame 51 is seated in the undercut 53 and is held in position by screws 56 in a location substantially opposite the flange or strike plate 21. With this mounting the second frame 51 extends with its major length or axis normal to or at right angles to the direction 14.

The second frame 51 serves as a support and mounting for a plunger 58. In the present instance the plunger is made up of a number of separate parts secured together for ease in assembly and disassembly. Particularly included is a central body 61 approximately elliptical in transverse cross-section except for a flat side 62 to match the configuration of the opening in the face plate 54. The body 61 carries a pair of internally threaded, electrically conducting tubes 63. The tubes at one end receive screws 64 having heads which hold in position an outer cover plate 66. The screws 64 also clamp against the central body 61 an intervening spacer 67. The adjacent parts define an interior chamber 68 against one wall of which are supported an outer pair of electrical connectors 69 and 71. These tightly engage the respective conducting screws 64 and in that fashion are put into electrical communication with the conducting tubes 63.

The electrical connections to the tubes are continued by cooperating screws 73 and 74 which enter into the tubes and hold in position a flanged tubular enclosure 76. The screws 73 and 74 also support solder connectors 77 and 78. Related ones of flexible insulated wires 79 and 81 are secured to the connectors. The other end of the wires 79 and 81 are anchored in an end plate 82 by terminal posts 83 and 84. They receive conductors 86 and 87 extending, for example, to the lock unit 9, as shown in FIG. 1. The conductors 79 and 81 are of sufficient flexibility to permit repeated reciprocation of the plunger in the second frame while maintaining continuous electrical contact from the conductors 86 and 87 to the connector pair 69 and 71.

The latter connectors 69 and 71 are supplemented by an additional pair of connectors 88 and 89 generally on the opposite wall of the chamber 68. For that reason the base member 61 is provided with a pair of through apertures in which the connectors 88 and 89 are slidably disposed. The pins have generally conical head portions on one end and have stems 91 and 92 on the other end confining movement of the pins to a direction normal to the direction 14. The pins are pressed generally fowardly or outwardly by springs 93 and 94 bearing against the pin heads and also bearing against a cross wall 96 forming part of the plunger and anchored in place around the tubes 63. The outward excursion of the connectors 88 and 89 is limited by stop rings 97 embracing the pins and adapted to abut the wall 96. The connectors 88 and 89 are individually connected by soldered, insulated, flexible conductors 98 and 99 to terminal posts 101 and 102 on the end plate 82. The posts are connected to conductors 103 and 104 arranged parallel to the conductors 86 and 87 and connected appropriately for use.

Figure 6:
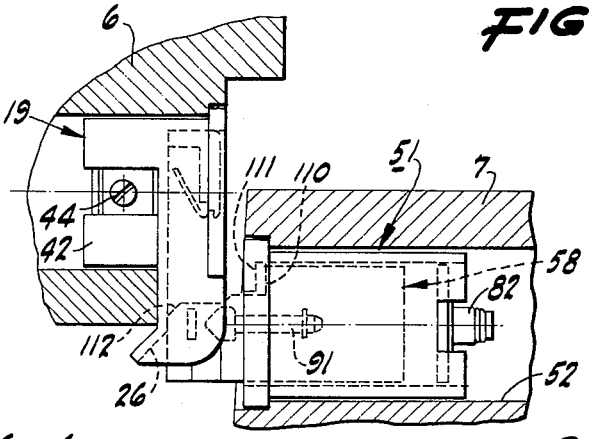
FIG. 6 is a view similar to a fragment of FIG. 1, with the door panel in partially open position.
Figure 5:
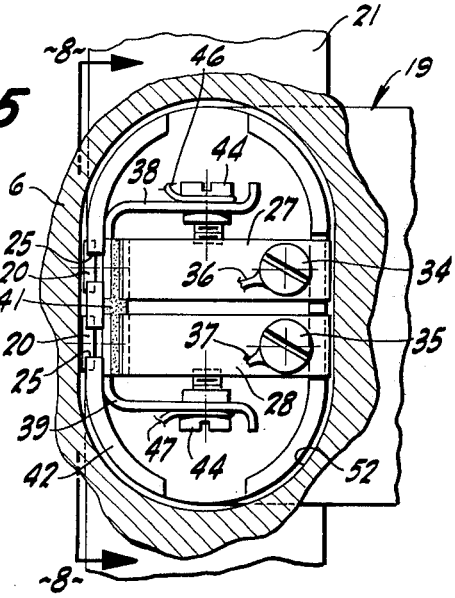
FIG. 5 is an end elevation, the plane of which is indicated by the line 5—5 of FIG. 2.
Figure 7:
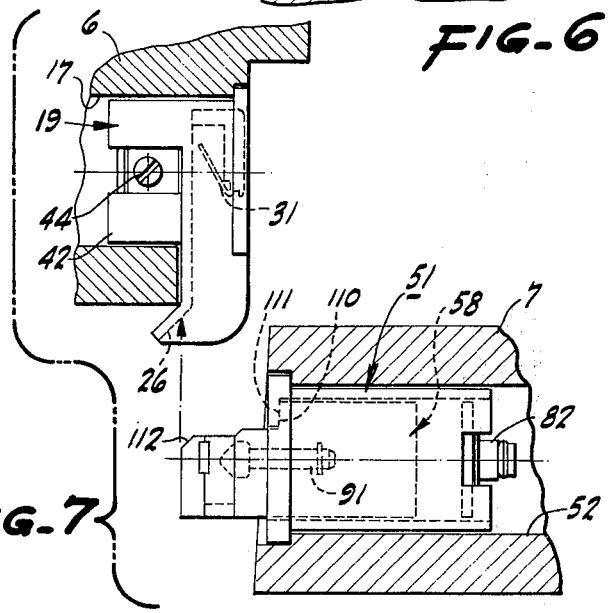
FIG. 7 is a view similar to FIG. 6 but with the door panel in an open position.
Figure 8:
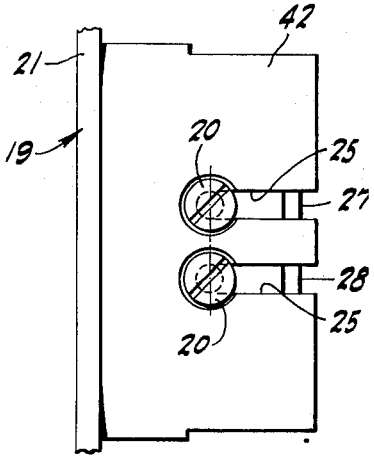
FIG. 8 is a side elevation, the plane of which is indicated by the line 8—8 of FIG. 5.

For accessibility the end plate 82 is removably held in position within the second frame by a spring retainer 106 (FIG. 3). This has snap ends 107 adapted to spring into openings 108 in the second frame to hold the parts in assembled condition. The end plate 82 also serves as a base for a helical spring 109 abutting the cross wall 96 and extending through the extension 76 thereof. The spring is thus shrouded against buckling against the adjacent conductors. The spring is effective normally to project the plunger until a shoulder 110 thereon (FIGS. 4, 6 and 7) abuts against an inturned flange 111 on the face plate 54.

In the operation of this arrangement the door panel 7 moves in the direction of the arrow 14 and toward the stop 13 in closing. In the final movement the end of the plunger 58, as shown particularly in FIG. 7, especially a beveled cam surface 112 thereon, strikes and cams over the cooperating cam surface 26 on the first frame. The projecting plunger is thus driven inwardly in a direction normal to the direction 14 as the door panel closes to abutting position with the door frame. The plunger movement not only compresses the spring 109 but lines up the parts so that the outer pair of contacts 69 and 71 on the plunger rides against and over the inner pair of resilient tips 29 and 31 of the inner connectors 27 and 28 on the first frame, thereby establishing two connections. At about the same time, the pair of inner connectors such as the pins 88 and 89 on the plunger slide over the exposed surfaces of the outer pair of connectors 38 and 39, thereby making another pair of connections.

Since the resilient tips 29 and 31 yield in a direction normal to the direction 14, and since the connectors 88 and 89 yield in the same sense but in the opposite direction, there is firm contact made between four connectors. Because of possible door sag (an angular or vertical motion, or both, in a vertical plane), there is adequate clearance between the upper and lower surfaces of the plunger and the upper and lower surfaces of the recess 23 so that the door panel can shift or rock a substantial amount without interfering with the integrity of the resilient connections by the sliding, even twisting, contacts. Furthermore, the stop 13 may not be actually abutted by the door panel due to shrinkage or mishanging or the like. Even so, to and fro swinging movement of the door panel may cause rattle but does not disrupt the electrical connections because the various contact surfaces are pressed against each other either by their inherent springiness or by their yielding nature. The resilient movability of the plunger under the influence of the spring 109 also assists not only in initial connection engagement but also in maintaining electrical connection despite door rattling or other minor movement.

When the door panel is closed or substantially closed, all of the conducting parts of the structure are well concealed or protected against tampering, particularly against introduction of spurious conductors from the outside as the stop 13 guards the plunger from that side. The connectors 38 and 39 are likewise well protected within the recess in the first frame. When the door panel is open the connectors 38 and 39 are exposed, but they do not project and being at relatively low voltage present no inherent danger; and since there is then a disconnection with the lock or other electrical mechanism tampering is not a problem. Connectors within the plunger chamber 68 are not readily accessible and do not project therefrom. The plunger itself is of a shape and location not readily to catch on clothing or the like of a person passing by the coupler, certainly no more so than the customary latch bolt on the lock set 9. The mechanism can be assembled and disassembled by tools ordinarily available to the casual workman. The multiplicity of conductors, some of which may sometimes not be used, allows for the supply of power and for the conduct of controlling impulses or both to installations on the door panel. The circuitry is not exposed or accessible when the door is closed. No unusual cutting in the door panel or in the door frame is needed for installation in wooden, composition or metal doors.

In some instances it is desirable to have somewhat longer flexible, electrical connectors to lengthen the life of the structure as to number of operations, and it is also desirable to simplify the construction. For those reasons, and as especially shown in FIGS. 13-16, inclusive, I sometimes provide an electric power coupler having a face plate 116 comparable to the face plate 54 and designed for similar installation opposite a frame unit of the sort shown in FIG. 2. In the modified device, many of the constructions are exactly as previously described or are only slightly modified.

Figure 13:
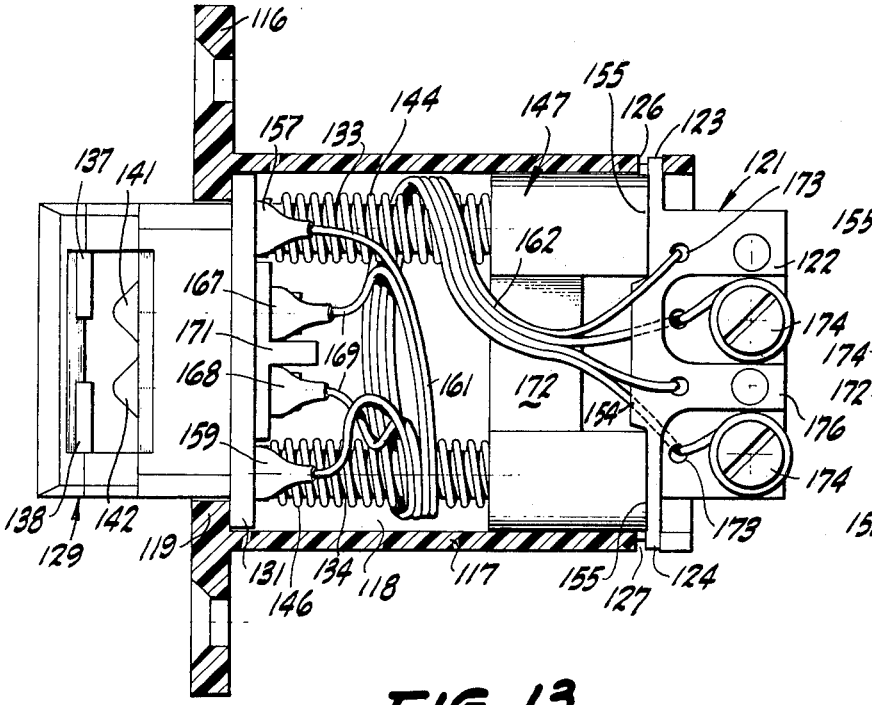
FIG. 13 is a side elevation, with portions of the second frame broken away, showing a modified form of electric power coupler unit.
Figure 14:
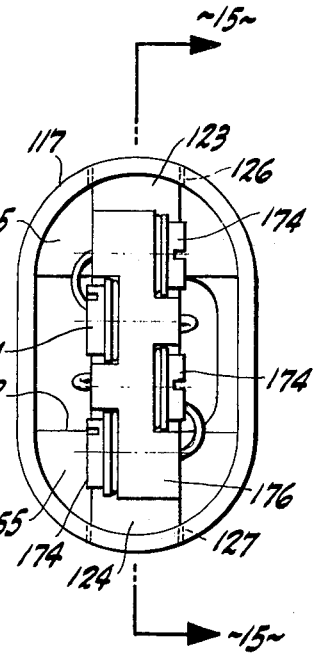
FIG. 14 is an end elevation of the coupler unit of FIG. 13.
Figure 15:
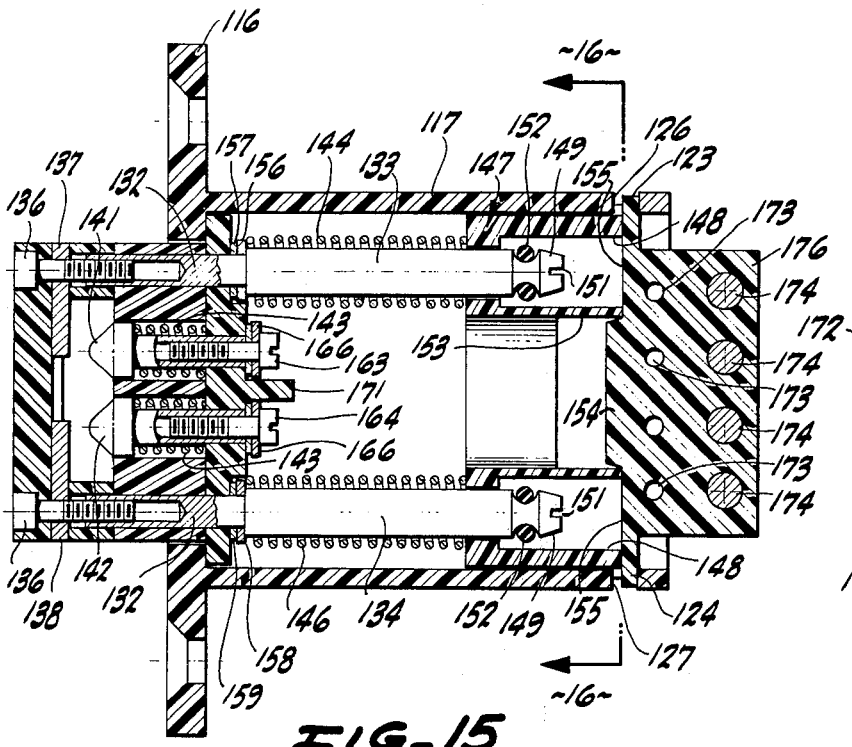
FIG. 15 is a cross-section, the plane of which is indicated by the line 15—15 of FIG. 14.
Figure 16:
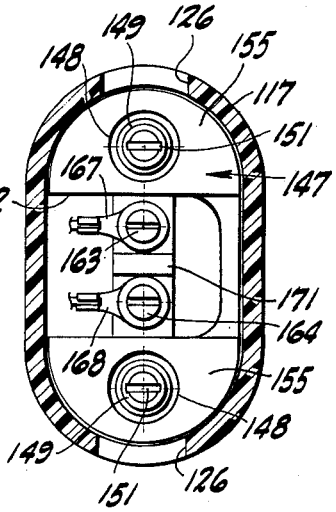
FIG. 16 is a cross-section, the plane of which is indicated by the line 16—16 of FIG. 15.

The simplified face plate 116 forms part of a second body 117 vertically elongated and laterally compact to have a substantial "racetrack" cross-section. This defines an interior chamber 118 at one end having an inturned flange 119 and at the other end carrying a removable end plate 121. The end plate includes a terminal block 122 formed with a pair of lugs 123 and 124 adapted to be loosely received in slots 126 and 127 near the end of the second body. The dimensions are preferably such that the end plate 121, if otherwise unrestrained, can be shifted laterally to disengage one of the lugs, such as 123, from its slot 126. The shifted end plate then can be rotated or rocked slightly (clockwise, as seen in FIG. 13), approximately pivoting the lug 124 in the slot 127. In the so-rotated position, the lug 123 lies beyond and misses the end of the second frame. The end plate is unhooked and can be lifted away, with the lug 124 leaving the slot 127. A reverse motion assembles the two parts.

Designed to reciprocate within the face plate 116 is a plunger 129 constructed almost the same as the plunger 58 but in this instance having an extended flange 131 adapted in one position of the plunger to abut the back of the face plate 116. The plunger can slide loosely along the interior of the second body 117 between the flange 131 and a position close to the end plate 121.

Extending through the flange 131 of the plunger mechanism are the reduced portions 132 of a pair of posts 133 and 134 extending parallel to the axis of the second body and parallel to the direction of motion of the plunger. The posts are held in position in the plunger by fasteners 136 threaded into central, threaded holes in the reduced portions 132 and, with the shoulders between the posts and the reduced portions, serving to keep the plunger in assembled condition. In addition, the fasteners 136 form part of electrical paths between connectors 137 and 138 (corresponding to the connectors 69 and 71) and the posts 133 and 134. The electrical connection is made because the fastenings 136 and the posts 133 and 134 are both of metal.

Adjacent and opposite to the connectors 137 and 138 there are connectors 141 and 142 similar to the connectors 88 and 89. The connectors 141 and 142 are yieldingly held in position by springs 143 acting against the enlarged heads of the connectors and also against the flange portion 131. The connectors 141 and 142 can yield slightly in an axial direction, as they are resiliently mounted in the plunger.

The plunger is normally urged into projected position in a resilient fashion by a spring 144, surrounding the post 133, and a spring 146, surrounding the post 134. The springs at one end rest against a travelling block 147 loosely slidable within the second frame and on the posts 133 and 134, the block being constrained to a rectilinear or axial movement by such mounting. The sliding block 147 has a pair of recesses 148 therein surrounding the heads 149 of the posts 133 and 134, the heads having tool-receiving slots 151 therein. The post shanks are reduced to receive resilient O-rings 152 having a larger diameter than the bearing apertures in the sliding block surrounding the posts 133 and 134. Until the O-rings are detached, the posts 133 and 134 cannot separate from the travelling block.

The block 147 is urged by the springs 144 and 146 against the end plate 121, and in the end position the sliding block and the end plate are interlocked. This is accomplished by the walls of a central recess 153 in the travelling block interengaging with a slant-walled central boss 154 on the inner face of the end plate 121. Thus, the end plate cannot be shifted laterally and detached from the second frame as described above until the travelling block 147 has been displaced inwardly enough to disengage the block from the central boss 154. Normally the movable parts are interlocked in assembled position, but by using any appropriate tool and forcing the sliding block inwardly to compress the springs 144 and 146 the user can quickly disassemble the mechanism. For example, by pushing a rod against an exposed face such as 155 (FIGS. 13 and 14) of the sliding block, and after free removal of the end plate 121, the user can withdraw the sliding block 147 and the plunger as a sub-assembly from within the second frame. Reassembly of the structure is accomplished by a reverse operation, the walls of the central recess 153 camming onto the boss 154 and again locking the parts.

Electrical connections between the plunger and the end plate are accomplished by relatively long, flexible conductors. For that reason, in the assembly of the post 133 with the plunger a washer 156 is interposed between the end of the spring 144 and an electrical terminal 157 like the terminal 77. The terminal 157 is thereby held in position and in conducting relationship with the connector 137. Similarly, the post 134 is assembled with a washer 158 bearing against an electrical terminal 159 in communication with the conductor 138.

Both of the terminals 157 and 159 are provided with their own, individual flexible leads 161 forming part of a lead bundle 162 of laterally joined insulated conductors. Similarly, the connectors 141 and 142, comparable to the connectors 88 and 89 in the earlier version, have internally threaded tubes into which screw fastenings 163 and 164 are driven, there being intervening washers 166 and terminals 167 and 168 for the respective connectors 141 and 142. The terminals 167 and 168 have their own leads 169, separated by a ledge 171 of insulating material, and then joined to the conductor bundle 162 with the remaining conductors Preferably the whole conductor bundle is of substantial length for low unit flexure and is wrapped around or outside of the posts 133 and 134 and particularly outside of or around the springs 144 and 146. The conductor bundle loop is disposed with some clearance within the interior chamber 118 of the second body 117. The conductors can be variously arranged within the chamber 118, but the arrangement illustrated has proved to be practical. The conductor bundle 162 is led through a central gap 172 in the travelling block, the gap leading into the recess 153. The conductors are spread apart and separated from their bundle. Each travels through a respective one of a number of openings 173 in the end plate 121, from which the conductor goes to the appropriate one of a number of screw terminals 174 arranged in pairs on opposite sides of the rearwardly projecting central web 176 of the end plate 121. The screw terminals 174 are designed for connection to incoming leads, so that the appropriate circuitry is joined to the connector.

With this arrangement of conductors, the travelling block 147 can be moved axially in and out, primarily for assembly and disassembly. More particularly, the plunger 129 can move in and out a large number of times without in any way overflexing the conductor bundle 162 so as to induce failure thereof. The conductor bundle 162 need not contact the springs 144 and 146; nevertheless if the conductor bundle does not come into contact with such springs it is moved in the proper direction as the springs compress and expand. There has thus been provided a somewhat simplified and long-lived version of the power connector.

We claim:

1. An electric power coupler for use with first and second door members relatively movable along a predetermined path toward and away from substantial abutment comprising a first frame adapted to be mounted on said first door member, a first electrical connector having a first exposed surface, means for mounting said first connector on said first frame with said first exposed surface parallel to said path, a second frame adapted to be mounted on said second door member, a plunger, means for mounting said plunger on said second frame for movement normal to said path, a second electrical connector having a second exposed surface, means for mounting said second connector on said plunger with said second exposed surface parallel to said path, means for urging said plunger in a direction normal to said path to abut said connectors with each other, and a conductor mounted on said second frame and engaging said second electrical connector.

2. A coupler as in claim 1 including means for resisting said urging means and stopping said plunger in a position projecting from said second frame.

3. A coupler as in claim 2 including means defining camming surfaces on said first frame and said plunger for moving said plunger against said urging means when said door members move along said path toward and substantially into abutment.

4. A coupler as in claim 1 in which said first and second door members move up and down relative to each other and in which said first and second exposed surfaces when in abutment with each other remain in contact as said members move up and down.

5. A coupler as in claim 4 including additional exposed surfaces on said first frame and said plunger spaced from said first and second exposed surfaces and in which said additional exposed surfaces when in abutment with each other remain in contact as said members move up and down and remain spaced from said first and second exposed surfaces.

6. A coupler as in claim 1 including a first additional connector having an exposed surface adapted to yield in a direction normal to said path, and means for mounting said first additional connector on said first frame in a location alongside of but spaced from said first electrical connector.

7. A coupler as in claim 1 including a second additional connector having an exposed surface, means for mounting said second additional connector on said plunger in a location alongside of but spaced from said second electrical connector and with said exposed surface thereof parallel to said path.

8. An electric power coupler for use with first and second door members relatively movable along a predetermined path toward and away from substantial abutment comprising a first frame adapted to be mounted on said first door member, said first frame having a recess therein with an opening laterally in the direction of said path, at least a first electrical connector extending parallel to said path, means for mounting said first connector on said first frame in said recess and directed toward said opening, a second frame adapted to be mounted on said second door member, a plunger having a chamber therein with an aperture open laterally in the direction of said path and complementary to said opening, means for mounting said plunger on said second frame for movement relative thereto in a direction normal to said path, at least a second electrical connector extending parallel to said path, means for mounting said second connector on said plunger and in said chamber directed toward said aperture and toward said first connector, and a conductor on said second frame and joined to said second connector.

9. A coupler as in claim 8 in which said second connector includes a pin mounted on said plunger to move relative to said plunger in a direction normal to said path.

10. A coupler as in claim 9 including a spring urging said pin out of said plunger.

11. A coupler as in claim 10 including a stop for limiting movement of said pin out of said plunger.

12. A coupler as in claim 9 in which said chamber has oppositely disposed walls and said pin projects from one of said walls into said chamber.

13. A coupler as in claim 12 in which an additional connector lies along the other one of said walls.

14. A coupler as in claim 8 in which said first electrical connector is entirely within the confines of said recess and said second electrical connector is entirely within the confines of said chamber.

* * * * *